US006092748A

United States Patent [19]

Keyssner et al.

[11] Patent Number: 6,092,748

[45] Date of Patent: Jul. 25, 2000

[54] BLADE RING FOR AIR-SWEPT ROLLER MILLS

[75] Inventors: Michael Keyssner, Duesseldorf; Thomas Letsch, Duisburg, both of Germany

[73] Assignee: Loesche GmbH, Duesseldorf, Germany

[21] Appl. No.: 09/236,087

[22] Filed: Jan. 25, 1999

[30] Foreign Application Priority Data

Sep. 25, 1998 [DE] Germany ..... 198 44 113

[51] Int. Cl.[7] ..... B02C 15/00

[52] U.S. Cl. ..... 241/47; 241/107; 241/109

[58] Field of Search ..... 241/47, 107, 109, 241/119

[56] References Cited

U.S. PATENT DOCUMENTS 5,186,404 2/1993 Wark ..... 241/119
5,607,111 3/1997 Brundiek ..... 241/18
5,622,321 4/1997 Brundiek et al. ..... 241/79.1
5,667,149 9/1997 Eisinger ..... 241/18
5,819,947 10/1998 Nardi et al. ..... 241/119 X

FOREIGN PATENT DOCUMENTS

3418196 A1 11/1985 Germany .

*Primary Examiner*—John M. Husar
*Attorney, Agent, or Firm*—Evenson, McKeown, Edwards & Lenahan, P.L.L.C.

[57] ABSTRACT

To reduce the manufacturing costs of air-swept roller mills and comparable mills and for optimizing the grinding and classifying processes via the flow direction of the fluid-grinding material mixture, according to the invention a blade ring is provided, which has pivotable guide blades. The blade ring is constructed as a polygon blade ring in segment form with at least one outer jacket ring or outer ring, which is constructed in segmented, polygonal manner and comprises a plurality of outer polygon segments formed from planar sheet metal blanks. One or more pivotable guide blades can be arranged with an upper, lower or central pivot axis on the polygon segments and can be pivoted and locked with no or few stages.

22 Claims, 3 Drawing Sheets

BLADE RING FOR AIR-SWEPT ROLLER MILLS

BACKGROUND OF THE INVENTION

The invention relates to a blade ring for air-swept roller mills having an outer ring and an inner ring, between which are positioned guide blades, accompanied by the formation of flow ducts.

Air-swept roller mills, bowl mills or also vertical air flow mills have grinding rolls rotatable about a fixed axis and which are placed on a rotary grinding bowl. Between the grinding bowl and the mill casing is formed an annular space, in which are positioned substantially radially oriented guide blades for guiding an upward carrier gas flow, e.g. an air flow, with which the ground material is supplied to a classifier. The annular space is constructed as an annulus and with the guide blades located therein is referred to as a blade ring and sometimes as a nozzle ring.

Known blade rings comprise a rolled, cylindrical or conical outer ring and inner ring or a combination of a conical outer or inner ring and a cylindrical inner or outer ring, between which are positioned the guide blades. The guide blades form flow ducts, which generally have a rectangular cross-section.

Apart from these blade rings comprising rolled rings and welded in guide blades, cast blade rings are also known.

The known blade rings are associated with relatively high manufacturing costs. In the case of large roller mills, which can have blade rings with an external diameter up to 7 m, additionally the transportation and installation are difficult to control and are costly. It is therefore known to segment the blade rings and to assemble in situ the individual segments or annular sectors. However, segmentation presupposes an annealing treatment, so that the ring structure is stress-relieved and separating cuts for producing the segments give rise to no deformation and in particular no cracking. Another disadvantage of known blade rings is that it is impossible to optimize the grinding and classifying process via the flow direction of the fluid introduced into the grinding chamber through the blade ring and the two-phase mixture of the fluid and the grinding material particles supplied to a classifier without dismantling the blade ring and fitting a blade ring with a different inclination of the individual guide blades.

In a blade ring known from DE 34 18 196 A1, the flow conditions are varied during mill operation by adjustably positioned outer ring segments. The guide blades are fixed and secured with an unchanged angle of inclination to the inner ring or inner ring segments and project outwards between terminal guidance and fixing parts. In the case of a maximum cross-section of the flow ducts, the horizontally adjustable outer ring segments extend up to the mill casing and in the case of a minimized cross-section to the guide blades.

A free annular space of the blade ring resulting from the travel of the outer ring segments, is disadvantageous because through this free annular space the fluid flow flows in such a way that it is not influenced by the inclination of the guide blades.

Another disadvantage is the lateral guidance and fixing parts, which define an outer ring segment and an inner ring segment and represent disturbing covers of the blade ring cross-section.

SUMMARY OF THE INVENTION

The object of the invention is to provide a blade ring for air-swept roller mills and comparable mills, which permits a relatively simple construction as well as an optimization of the grinding and classifying process, particularly during mill operation.

One fundamental idea of the invention is to provide a blade ring with pivotable guide blades. As a result of the fact that the guide blades are arranged pivotably and can be fixed with a pivot angle adapted to the particular requirements, it is possible to optimize the flow direction of the fluid or carrier gas supplied through the blade ring to the grinding chamber and to influence the flow direction of the two-phase mixture of fluid and grinding material particles in the grinding-classifying chamber of the mill. It is possible to carry out the inventive optimization of the grinding and classifying processes of a mill by means of a variable guide blade inclination without any costly dismantling of a blade ring and fitting a new blade ring with a different blade inclination.

Appropriately the guide blades are pivotably fixed by their pivot axis of the outer ring or an outer jacket of the blade ring or an outer jacket of the blade ring and can be adjusted by means of a mechanism accessible from the outside. There is consequently no need to interrupt mill operation, in order to vary the flow direction of the fluid and the fluid-grinding material mixture via a modified inclination of the guide blades.

It is advantageous that the guide blades of the blade ring are pivotable in a pivoting range formed by a pivot angle $\alpha$ of approximately 30° to 150°. The pivot angle $\alpha$ is related to a horizontal placed through the pivot axis of the guide blades and which runs parallel to the associated flow surface of the blade ring. The blade ring can have an outer jacket or outer ring and an inner jacket or an inner ring or an outer ring and as inner ring an outer surface of the grinding bowl.

Through an adjustment of the inclination with a pivot angle in the range of approximately 30° to approximately 150° or of −30° to 90° or 90° to 150°, the possibility exists of not only forcing the fluid flow in a direction coinciding with the rotation direction of the grinding bowl, but also in a direction opposed to the rotation direction of the grinding bowl.

In order to achieve a complete influencing of the fluid flow direction, it is appropriate to construct the outer jacket ring, hereinafter referred to as the outer ring for simplification purposes, and the inner jacket ring, hereinafter referred to as the inner ring for simplification purposes, in such a way that the pivotable guide blades for each settable pivot angle form the narrowest possible gap with respect to the adjacent wall surfaces, particularly to the outer ring. It is therefore advantageous if at least the outer ring has in the pivoting areas of the individual guide blades a planar surface running perpendicular to the guide blades.

According to a particularly preferred embodiment, the blade ring comprises a plurality of polygon segments, which are planar and not curved and are connected to a closed polygon. Such a polygon blade ring in segment form is much more advantageous compared with the known blade rings, which are only split up into individual segments following manufacture and then assembled again in situ and also compared with the segmented blade ring with horizontally adjustable outer ring segments as regards manufacture, transportation, installation and particularly the influencing of the grinding and classifying processes with the aid of pivotable guide blades for modifying the flow direction of the fluid-grinding material mixture.

The polygon blade ring in segment form has, in a particularly advantageous construction, a polygonal outer ring with a plurality of outer polygon segments, whose number and dimensioning can be determined in accordance with the size of the blade ring or the mill and as a function of the length and the predeterminable pivot angle of the pivotable guide blades.

In particular, the pivot angle of one or more guide blades in the vicinity of an outer polygon segment determines its minimum length, the length of the outer polygon segments being the chords or connecting paths between points of the polygon located on a circle surrounding the polygon. This leads to an inexpensive manufacture of the blade ring constructed as a polygon or the outer ring in segment form, because the outer polygon segments and optionally also the inner polygon segments can be manufactured from flat metal sheets and by multiple cutting.

Another advantage is that the blade ring polygon segments which can be installed in situ can be prefabricated and can comprise an outer polygon segment with one or more pivotable guide blades or an outer polygon segment and associated inner polygon segment with one or more guide blades pivotably fixed to both segments.

The pivotable guide blades can have differently positioned pivot axes and can be fixed in the vicinity of a blade ring segment in accordance with the pivot axis arrangement. It is particularly advantageous to have guide blades with a centrally positioned pivot axis. This pivot or adjusting axis is perpendicular to the flow surfaces of the outer ring segments and inner ring segments, i.e. is correspondingly inclined in the case of sloping outer and inner ring segments. The pivot axis can also be formed in the area of a lower edge of the guide blades, which can also be referred to as the gas entry edge compared with a blade upper edge or a gas exit edge. Fundamentally, through the construction of the gas entry or exit edges of the guide blades, additional flow influencing can take place. Particularly in the case of a pivot axis on the lower guide blade edge, a rounded or streamlined construction is advantageous and this can be continued in the shape of the guide blades themselves. Thus, the guide blades can be planar or curved.

For adjusting the inclination of the guide blades, it is advantageous to use an adjusting mechanism, which permits an adjustment outside the mill casing and during mill operation. The adjusting mechanism can be provided for one guide blade, for several guide blades positioned on a blade ring polygon segment for groups of guide blades on several blade ring polygon segments or for all guide blades and can be constructed for adjusting individual, groups or all the guide blades.

It is also appropriate to lock the guide blades in their given inclination, in order to avoid an undesired displacement or "fluttering" of the guide blades. For example, for locking purposes, it is possible to have a clamping or fixing device on the guide blades and advantageously on the outer wall of the mill casing. It is particularly appropriate to integrate the locking of the guide blades into the adjusting mechanism.

The adjustment of the guide blades can be performed in a particularly simple variant manually and either from the mill interior or from outside the mill. An automatic setting is possible using per se known mechanical, electrical and hydraulic elements. For transferring the adjusting movements use can be made of per se known drives, e.g. gear drives, crank drives, coupling rods with hinge bearings particularly ball-and-socket-joints.

BRIEF DESCRIPTION OF THE DRAWINGS

The invention is described in greater detail hereinafter relative to the attached highly diagrammatic drawings, wherein show.

DETAILED DESCRIPTION OF THE DRAWINGS

Figure 1:
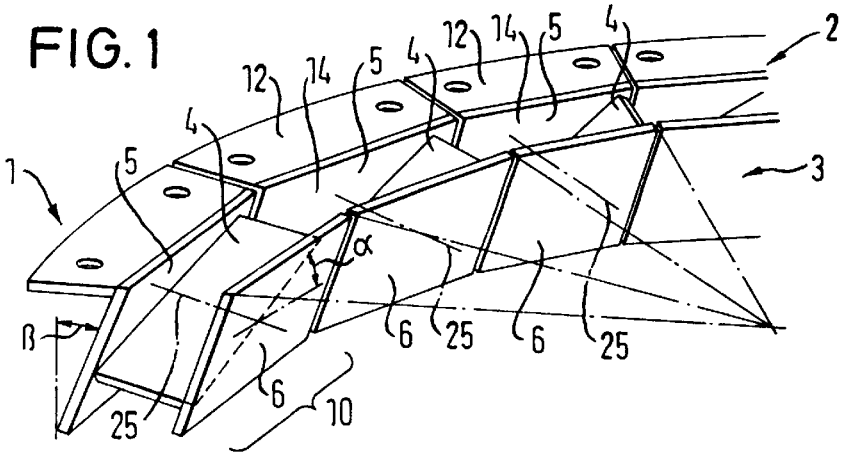
FIG. 1 A detail of a first variant of an inventive polygon blade ring in segment form and perspectively.

FIG. 1 shows in exemplified manner a first variant of a polygon blade ring 1 in segment form in a detail perspective view. The polygon blade ring 1 has an outer jacket or outer ring 2, an inner jacket or inner ring 3 and guide blades 4, which are radially positioned between the outer ring 2 and the inner ring 3 and pivotable about a centrally constructed pivot axis 25.

The polygonal blade ring 1 comprises a plurality of lined up, connected polygon segments 10, which in each case have planar, facing outer polygon segments 5 and inner polygon segments 6 and a pivotable guide blade 4. It is also possible to fit two, three or more pivotable guide blades 4 to a polygon segment 10. The inclination direction of the guide blades 4 is shown in exemplified manner in FIG. 1 and the remaining drawings and can also be in the opposite direction. In plan view the segmented blade ring 1 represents a closed polygon, which as a result of the plurality of polygon segments 10 virtually forms a circle (cf. FIG. 4). In the example of FIG. 1, the inner polygon segments 6 are roughly parallel to the inwardly inclined outer polygon segments 5 and the radially interposed guide blades 4 form flow ducts 14. The angle of inclination $\beta$ of the outer polygon segments 5 can e.g. be approximately 15°. The facing planar surfaces of the inner polygon segments 6 and outer polygon segments 5 ensure an adjustment of one or more guide blades 4 and a very small gap between the lateral edges 24, 34 and the outer and inner polygon segments 5, 6 (cf. FIG. 3).

To facilitate understanding, FIG. 1 only diagrammatically represents the pivot pins 25 of the guide blades 4. It is clear that the pivot pins 25 do not run entirely horizontally in accordance with the angle of inclination $\beta$. As a result of the arrangement of the guide blades 4 in the vicinity of the blade ring segments 10, which can also be referred to as polygon segments, the pivot axis 25 is formed roughly centrally in the guide blades 4 and the latter, with the pivot axis 25, are guided virtually centrally in the inner polygon segments 6 and outer polygon segments 5 and can be pivoted and fixed in a pivoting range of approximately 30 to 150°.

The outer polygon segments 5 can be provided with a cover and fastening, which can be segmented in complementary form and then has individual elements 10 or can also be integrated into the outer polygon segments 5.

Figure 2:
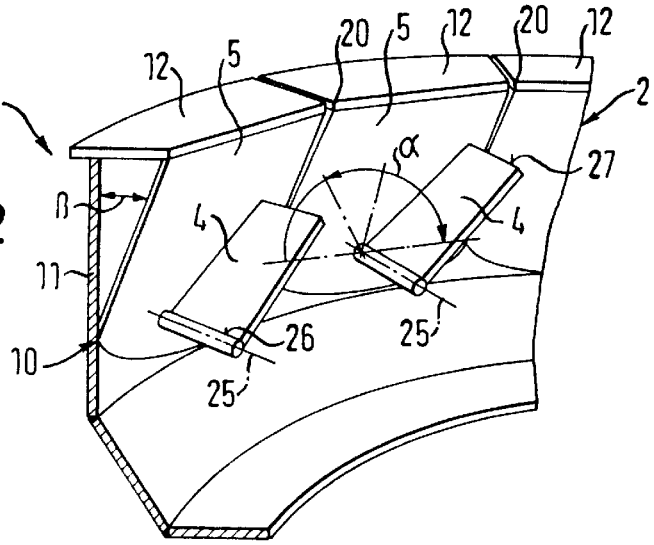
FIG. 2 A detail of a second variant of an inventive polygon blade ring in segment form perspectively.
Figure 3:
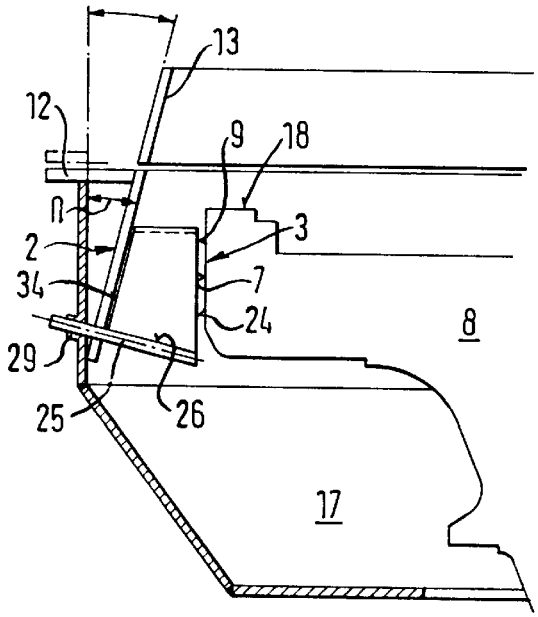
FIG. 3 A longitudinal section through an air-swept roller mill in the vicinity of a polygon blade ring according to the second variant.

FIGS. 2 and 3 show a second variant of a segmented polygon blade ring 1 with pivotable guide blades 4. In each case, the blade ring polygon segments 10 have an outer polygon segment 5 and a pivotable guide blade 4. In this variant there is no polygonal inner ring. The function of the inner ring 3 is taken over by the outer wall surface 7 of the grinding bowl 8, which has a cylindrical construction (FIG. 3).

The guide blades 4 are planar and provided on a lower guide blade edge 26 with a pivot axis 25 about which can be pivoted said guide blades 4 in a pivoting range and can be fixed with a pivot angle α of approximately 30 to 150°.

The arrangement and dimensioning of a guide blade 4 on an outer polygon segment 5 and its dimensioning are adapted to the possible pivot angle α, so that it is possible to ensure an unhindered adjustment and a small distance between a guide blade 4 and the outer polygon segment 5, as well as the outer wall surface 7 of the grinding bowl 8.

FIG. 2 shows that several guide blades 4 can be placed on an outer polygon segment 5. In addition, the guide blades 4, also with pivot axis 25 on an upper guide blade edge 27 can be fixed in a virtually "suspended" manner on the outer polygon segments 5 and positioned so as to permit the necessary pivoting. There can also be an opposite inclination direction of the guide blades, i.e. the pivot angle α is approximately 90 to 150°.

FIG. 3 shows, like FIG. 2, guide blades fixed in "hanging" manner on the segmented, polygonal outer ring 2. The same means are given the same reference numerals. The guide blades 4 are pivotable about a pivot axis 25 on a lower guide blade edge 26. The pivot axis 25 passes outwards and can be manually or automatically (not shown) operated in the vicinity of the mill casing 11. A clamping device 29 is positioned on the outer wall of the mill casing 11 and prevents a "fluttering" and undesired adjustment of the guide blade 4. The clamping device 29 has a locking function and is one of the possible locking means, which should appropriately be integrated into the adjusting mechanism (not shown).

The asymmetrical construction of the guide blades 4 in the view of FIG. 3 results from the fixing of the outer polygon segments 5 to the mill casing 11 by means of elements 12 with an angle of inclination β and the cylindrical outer surface 7 of the grinding bowl 8, which in this variant of the blade ring 1 takes over the function of the inner ring 3, as well as the guide blades 4 arranged perpendicularly to the outer polygon segments 5. With their lateral edges 24 the guide blades 4 are positioned close to the outer surface 7 of the grinding bowl 8. An outwardly directed lateral edge 34 is complementary to the inclination of the outer ring segments 5 and the upper guide blade edge 27 is positioned roughly horizontally. The lower guide blade edge 26 with the pivot axis 25 is inwardly inclined and ensures a very simple adjustment. Above the outer polygon segments 5 are provided guide faces 13, which extend upwards the flow surfaces of the outer polygon segments 5 and it is possible to choose an angle differing from β. Thus, a fluid flow from an air duct 7 is guided away from the mill casing in the direction of the mill centre 28 (FIG. 4).

Figure 4:
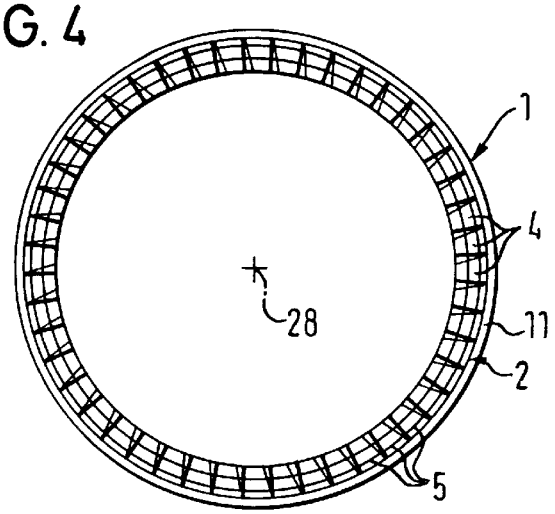
FIG. 4 A plan view of an inventive polygon blade ring in segment form with pivotable guide blades.

In a highly diagrammatic representation FIG. 4 shows a polygon guide blade ring 1 in segment form with pivotable guide blades 4 on a plurality of outer polygon segments 5. The representation makes it clear that as a result of the plurality of polygon segments 5 there is a relatively small divergence from the circular construction of the mill casing 11. This divergence is visible in FIG. 5, which is a larger scale detail of the polygon blade ring 1 of FIG. 4.

Figure 5:
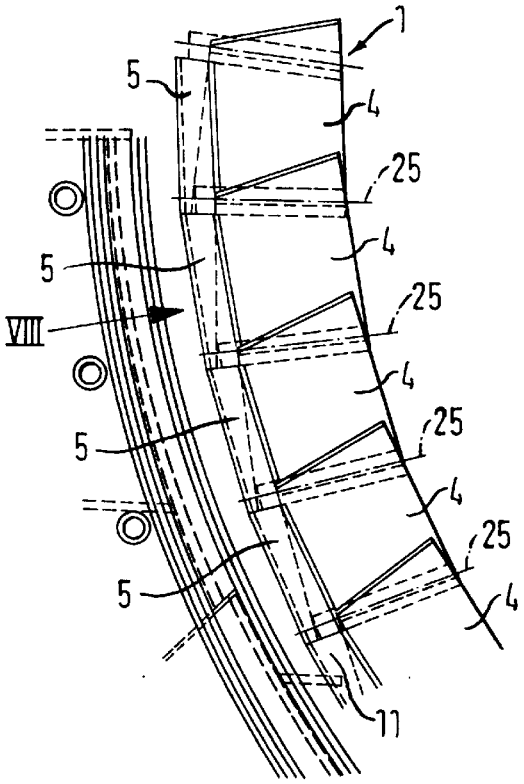
FIG. 5 A larger scale detail of the blade ring of FIG. 4.
Figure 6:
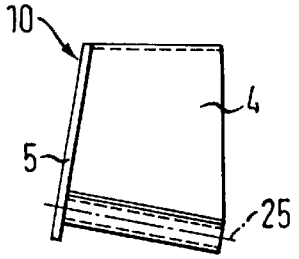
FIG. 6 A view of a blade ring polygon segment of the blade ring of FIG. 5.
Figure 7:
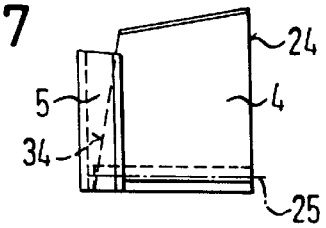
FIG. 7 A plan view of a blade ring polygon segment of the blade ring of FIG. 5.
Figure 8:
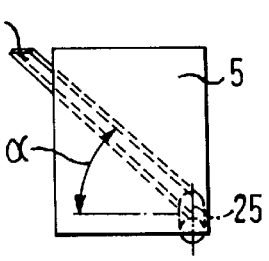
FIG. 8 A view of the blade ring polygon segment along arrow VIII in FIG. 5.

FIG. 6 is a view, FIG. 7 a plan view in accordance with FIG. 5 and FIG. 8 a rear view of an embodiment of a blade ring polygon segment 10, which has an outer polygon segment 5 and a pivotable guide blade 4 with a lower pivot axis 25. It is clear that the guide blades 4 are arranged roughly diagonally on an outer polygon segment 5 and extended for an optimum fluid flow reversal.

According to FIGS. 7 and 8 a guide blade 4 fixed with its lower pivot axis 25 in a lower, right-hand area of the outer polygon segment 5 can be pivoted in a pivot angle range α of approximately 30 to 90°. On guiding the pivot axis 25 in the lower, left-hand area the guide blade 4 would be set in the opposite direction and would reverse the fluid flow from a fluid duct 17 (FIG. 3) in the opposite direction, i.e. clockwise. FIG. 8 makes it clear that the guide blades 4 can advantageously be centrally positioned on the outer polygon segments 5 and/or with a central, not shown pivot axis and pivotable in both directions.

Figure 9:
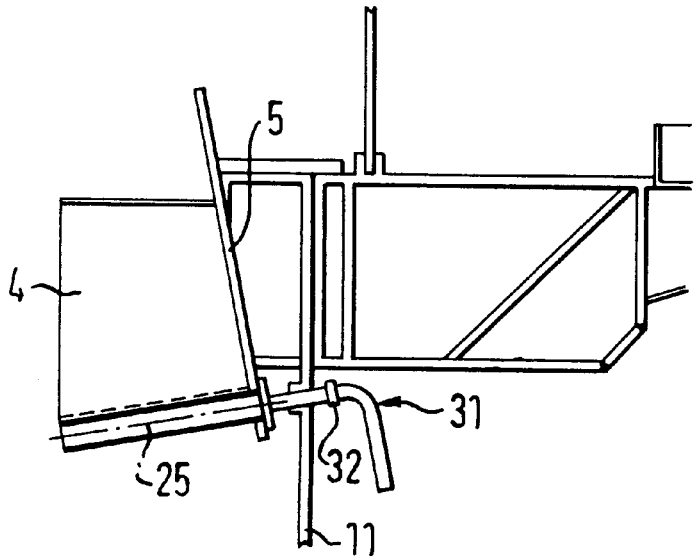
FIG. 9 A longitudinal section through an air-swept roller mill with a blade ring polygon segment and adjusting mechanism for a guide blade.
Figure 10:
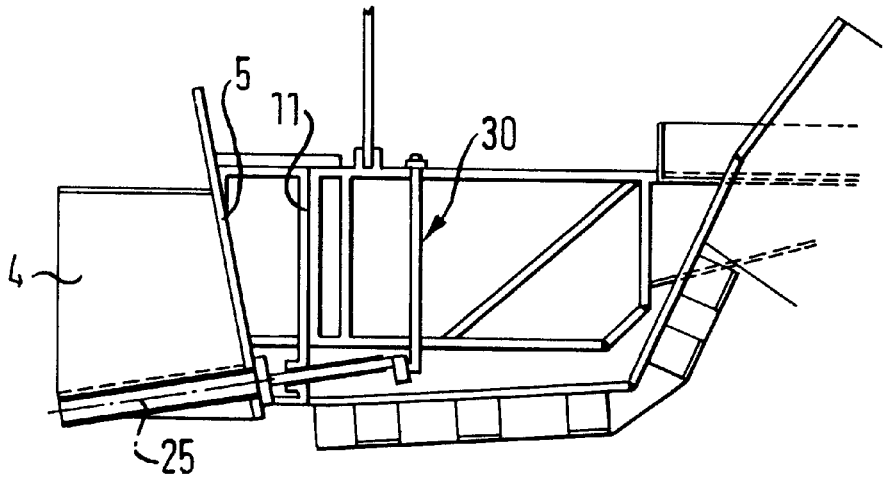
FIG. 10 A representation identical to FIG. 9 with a second variant of an adjusting mechanism for the pivotable guide blades.

FIGS. 9 and 10 show adjusting mechanisms for pivotable guide blades 4, which can be operated from the outside. The adjusting mechanism 31 diagrammatically shown in FIG. 9 is manually operable and has an adjusting element 32, which is guided through a guide opening of the mill casing 11 and is constructed for an engagement in the pivot axis 25 of the guide blades 4. A locking device 32 ensures a reliable fixing of the inclination-adjusted guide blades 4.

FIG. 10 shows a transfer mechanism 30 for the mechanical pivoting of the guide blades 4.

What is claimed is:

1. Blade ring for air-swept roller mills comprising:

an outer ring, an inner ring, and guide blades, said guide blades being arranged between said outer ring and said inner ring accompanied by a formation of flow ducts, said guide blades being pivotably arranged around a substantially horizontal pivot axis and fixable with a predeterminable pivot angle α.

2. Blade ring according to claim 1, said pivotable guide blades being fixable to said outer ring in the area of said pivot axis.

3. Blade ring according to claim 1, wherein said guide blades being pivotable in a pivoting range formed by a pivot angle α of approximately +30° to 90° and −30° to 90° or 30° to 150°, relative to a horizontal.

4. Blade ring according to claim 3, wherein said outer ring, at least in the pivoting ranges of said individual guide blades, being planar and perpendicular to the guide blades.

5. Blade ring according to claim 1, wherein said blade ring being constructed as a polygon blade ring in segment form having a plurality of polygon segments with at least one of said pivotable guide blade, βαα.

6. Blade ring according to claim 5, wherein said polygon blade ring in segment form having polygon segments, which are outer polygon segments with said pivotable guide blades fixed thereto and that said outer polygon segments being connected to the outer ring are planar and constructed for receiving said pivot axes of the guide blades.

7. Blade ring according to claim 6, wherein said pivot axes of the guide blades being in each case constructed on a lower guide blade edge or on an upper guide blade edge or between the upper and lower guide blade edges.

8. Blade ring according to claim 6, wherein said pivot axes of said guide blades being arranged centrally on said outer polygon segments.

9. Blade ring according to claim 6, wherein said inner ring being polygonal and comprising a plurality of inner polygon segments, said inner polygonal segments being sheet metal blanks and being positioned facing said outer polygon segments and constructed for receiving said pivot axes of said guide blades.

10. Blade ring according to claim 9, wherein a polygon segment of said polygon blade ring in segment form comprising an outer polygon segment, an inner polygon segment and at least one of said guide blades pivotable fixed to said outer polygon segment and said inner polygon segment and whose inclination adjustment can take place from an outside.

11. Blade ring according to claim 5, wherein said outer polygon segments being planar metal sheets are fixed with an angle of inclination $\beta$.

12. Blade ring according to claim 5, wherein said pivot axes of the guide blades being guided through said outer polygon segments and a mill casing or a ring duct wall and being operable from an outside for adjusting the inclination.

13. Blade ring according to claim 12, wherein said inclination adjustment of the guide blades taking place manually or automatically.

14. Blade ring according to claim 13, wherein an automatic inclination adjustment of the guide blades taking place mechanically, electrically or hydraulically.

15. Blade ring according to claim 14, wherein for said automatic inclination adjustment of the guide blades, transfer or transmission devices are provided.

16. Blade ring according to claim 1, wherein said guide blades being planar.

17. Blade ring according to claim 1, wherein said guide blades being curved.

18. Blade ring according to claim 1, wherein said guide blades being lockable in a predeterminable pivot angle $\alpha$.

19. Blade ring according to claim 18, wherein clamping devices are provided on outwardly guided pivot axes which lock the guide blades in a predeterminable pivot angle $\alpha$.

20. Blade ring according to claim 1, wherein said guide blades can be pivoted and fixed individually, in groups or all together.

21. Blade ring according to claim 1, wherein said inner ring being formed by an outer surface of a grinding bowl and said guide blades having an inner edge being positioned parallel and at a limited distance from said outer surface of said grinding bowl.

22. Blade ring according to claim 1, wherein said inner ring, at least in the pivoting ranges of the individual guide blades, is constructed in a planar manner perpendicular to the guide blades.

* * * * *